US005291832A

United States Patent [19]

Plummer

[11] Patent Number: 5,291,832

[45] Date of Patent: Mar. 8, 1994

[54] DUMMY ROUND

[76] Inventor: Magalene M. Plummer, 1008 Lovell View Dr., Knoxville, Tenn. 37922

[21] Appl. No.: 916,196

[22] Filed: Jul. 17, 1992

[51] Int. Cl.[5] ..... F42B 8/08

[52] U.S. Cl. ..... 102/444; 102/529; 42/90

[58] Field of Search ..... 42/96, 90; 102/444, 102/529

[56] References Cited

U.S. PATENT DOCUMENTS

| | | | |
|---|---|---|---|
| H700 | 11/1989 | Farinacci | 102/529 |
| 119,357 | 9/1871 | Hobbs | 102/444 |
| 2,405,308 | 8/1946 | Jack | 35/25 |
| 2,985,979 | 5/1961 | Doyle et al. | 42/1 |
| 3,292,538 | 12/1966 | Umbach et al. | 102/444 |
| 3,678,609 | 7/1972 | Fazio | 42/1 |
| 3,848,350 | 11/1974 | Seminiano | 42/1 |
| 4,708,065 | 11/1987 | Schilling et al. | 102/529 |
| 4,776,123 | 10/1988 | Ascroft | 42/70.11 |
| 4,965,952 | 10/1990 | Miller et al. | 42/70.01 |
| 5,097,613 | 3/1992 | Miller et al. | 42/70.01 |

FOREIGN PATENT DOCUMENTS

| | | | |
|---|---|---|---|
| 89994 | 3/1896 | Fed. Rep. of Germany | 102/444 |
| 2511686 | 10/1975 | Fed. Rep. of Germany | 102/444 |
| 305620 | 12/1936 | Italy | 102/444 |
| 2138547 | 10/1984 | United Kingdom | 102/529 |

*Primary Examiner*—Stephen M. Johnson
*Attorney, Agent, or Firm*—Pitts & Brittian

[57] ABSTRACT

A dummy round for use in firearms training. The dummy round can be loaded in a conventional semi-automatic or fully automatic weapon. The dummy round is configured in the same manner as a standard round of live ammunition. This allows the dummy round to be loaded in a clip, chambered and ejected in a normal manner. The casing portion and the bullet portion of the dummy round are constructed of a single integral unit in order to eliminate the risk of separation of the dummy bullet from the casing during ejection of casing from the chamber.

8 Claims, 2 Drawing Sheets

DUMMY ROUND

TECHNICAL FIELD

This invention relates to the field of firearms. More specifically, it relates to a dummy round to be used during firearms training sessions by law enforcement agencies and the armed forces.

BACKGROUND ART

Automatic and semi-automatic handguns and rifles utilize the exhaust gases that result from the discharge of a round. These gases apply force, in a rearward direction, to the weapon's bolt, forcing the bolt to travel in a rearward direction against the restraint of a spring. As the bolt is propelled backwards, an ejector mechanism engages the casing of the spent cartridge and ejects it. When the force applied by the gases against the bolt becomes the same as, and subsequently less than, the force of the spring, the bolt is returned to a closed position. As the bolt travels forward, it can chamber a subsequent round, if such a round is present, i.e. if the weapon is loaded. As the bolt travels in the above described path, in most automatic or semi-automatic weapons, the bolt "cocks" the weapon, i.e. the firing mechanism is placed in an armed position, ready to be fired by pulling the trigger. Thus after each round is fired, the weapon is placed in condition of being able to be fired a second time. Thus, a semi-automatic weapon may be fired as rapidly as the operator can pull the trigger. In an automatic weapon, the firing mechanism is automatically released as long as the trigger is being held back.

It is not uncommon for a cartridge to misfire, or not fire at all. Thus the bolt is prevented from properly ejecting the spent cartridge and from loading a fresh cartridge. Law enforcement agencies and the military train their personnel the correct way to react to such an occurrence and manually place the weapon in a condition to be fired, i.e. personnel are trained on the steps to take to clear the weapon of the unfired or misfired cartridge and chamber the next round.

In order to simulate a misfire, a dummy round will be loaded in a clip, intermixed with live rounds, and the clip is loaded into a weapon to be fired. The dummy round will not fire when chambered and the shooter will have to react and clear the weapon of the dummy round.

In U.S. Pat. No. 2,405,308, which issued on Aug. 6, 1946, Jack discloses a dry firing cartridge that has a separate bullet head and casing. Jack's cartridge is also provided with an internal piston, plate and integral spring that absorb the impact of the weapon's firing pin in order to prevent damaging the pin when the weapon is dry fired.

In U.S. Pat. No. 3,848,350, which issued on Nov. 19, 1974, Seminiano discloses another dry fire cartridge that is also constructed of a separate bullet head and casing. Seminiano discloses a soft, resilient material, which is injected into the primer cup, for absorbing the shock of the firing pin. Seminiano's dry fire cartridge is constructed of a standard spent casing that has been refitted with a standard bullet.

The problem associated with dry fire cartridges that have separate bullet and casing members is the potential for separation of the bullet from the casing. If, after repeated use, the bullet and the casing separate, the casing can be ejected leaving the bullet in the barrel. If a live round is then chambered and fired, the resultant back-pressure can damage the weapon and create the potential for severe injury. Dry fire cartridges that include an integral spring are also costly and difficult to manufacture.

In U.S. Pat. No. 3,678,609, which issued on Jul. 25, 1972, Fazlo discloses a safety plug for insertion into the chamber of a weapon, constructed of a single piece of flexible material, for preventing accidental discharge of the weapon. Fazlo's safety plug is not designed to be capable of being ejected by the weapon's conventional ejection mechanism and must be forcibly pushed out of the weapon's chamber. Fazlo's safety plug is not configured such that it is capable of being loaded into a clip. Further, Fazlo's safety plug is configured to make a weapon safe from accidental discharge and therefore is not intended to be capable of being loaded into and subsequently ejected from a weapon in the same manner as a live round.

In U.S. Pat. No. 4,776,123, which issued on Oct. 11, 1988, Ascroft discloses a safety plug for insertion into the chamber of a weapon for the purpose of preventing the weapon from being accidently loaded and/or fired. Ascroft's safety plug is dimensioned to form a tight press fit against the inside of the weapon's barrel and is not designed to be capable of being loaded into and subsequently ejected from a weapon in the same manner as a live round.

In U.S. Pat. Nos. 4,965,952 and 5,097,613, which issued on Oct. 30, 1990 and Mar. 24, 1992, respectively, Miller et al. disclose a safety plug which provides a visible indication that the safety plug is chambered. Both of Miller's safety plugs are provided with a button that is carried by the rear portion of the body of the safety plug. This button can be readily engaged by the weapon's ejector mechanism, thus allowing the safety plug to be quickly and easily discharged, and the weapon loaded with a live round, by working the extractor mechanism of a conventional weapon. Neither of Miller's safety plugs are adapted to be loaded in a clip to serve as a training dummy round.

In U.S. Pat. No. 2,985,979, which issued on May 30, 1961, Doyle et al. disclose a moisture absorbing plug for a firearm chamber. Doyle's moisture absorbing plug includes a separate casing and bullet portion, in one embodiment. The casing of Doyle's moisture absorbing plug is longitudinally corrugated.

Accordingly, it is an object of this invention to provide a dummy round which can be used as a training round and can be readily chambered in and ejected from a conventional semiautomatic or fully automatic weapon.

Another object of the present invention is to provide a dummy round that has its bullet portion and casing portion as a single unit, thus eliminating the risk of separation of the bullet from the casing.

Still another object of the present invention is to provide a dummy round that approximates the weight and feel of a conventional live round of ammunition.

Other objects and advantages over the prior art will become apparent to those skilled in the art upon reading the detailed description together with the drawings as described as follows.

DISCLOSURE OF THE INVENTION

In accordance with the various features of this invention, a dummy round for use in firearms training is provided, which can be loaded in a conventional semi-automatic or fully automatic weapon. The dummy round is configured in the same manner as a standard round of live ammunition. This allows the dummy round to be loaded in a clip, chambered and ejected in a normal manner. The dummy round has a casing member, a button carried by the rear end portion of the casing member and a bullet portion carried by the forward end portion of the casing member.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 4:
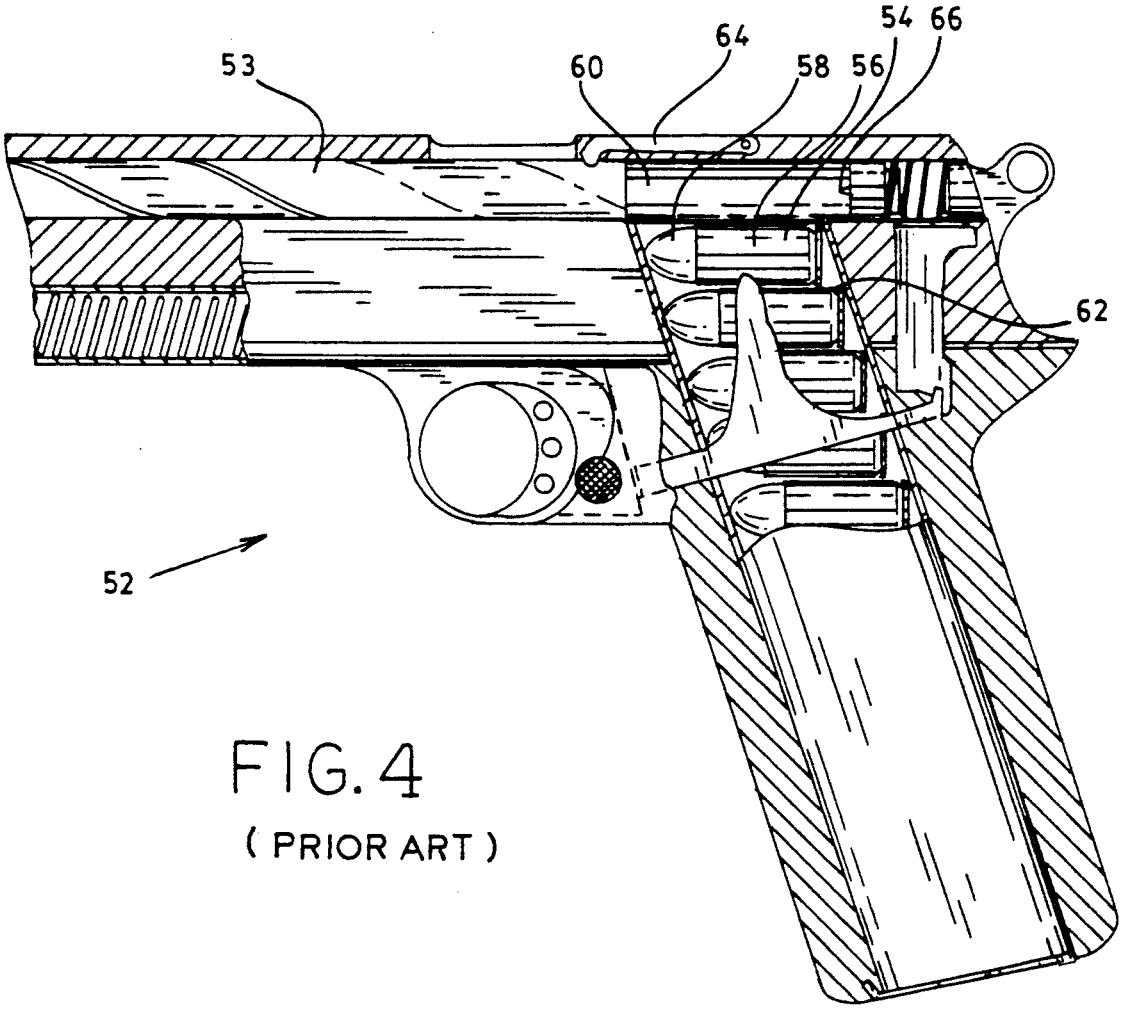
FIG. 4 ( PRIOR ART )
FIG. 4 illustrates a side elevational view, in section, of prior art.

A dummy round, constructed in accordance with the present invention is shown generally as 10 in the figures. Dummy round 10 is preferably fabricated of a lightweight metal. Dummy round 10 is, in the preferred embodiment, a one piece unit that is machined, molded or cast to configure a standard live round of ammunition. Dummy round 10 has a casing portion 15, which has a rearward portion 17 and a forward portion 19. A button 22 is carried by rearward portion 17. Centrally disposed on the rearward face 24 of button 22 is an indention or firing pin receiver 26 for receiving the weapon's firing pin 66 when the weapon 52 is fired. Disposed between button 22 and rearward portion 17 is an annular recess 28. Annular recess 28 and button 22 are configured so as to be engaged by the ejector mechanism 64 of a conventional automatic or semi-automatic weapon 52, as shown in FIG. 4.

Figure 1:
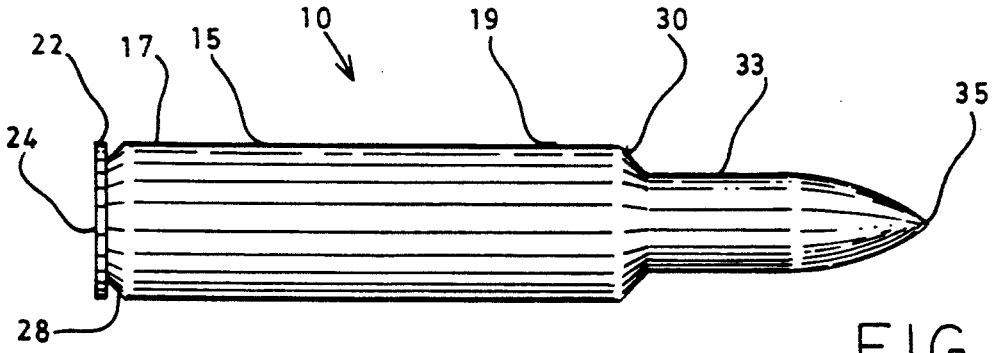
FIG. 1 illustrates a side elevational view of the preferred embodiment of the dummy round of the present invention.
Figure 2:
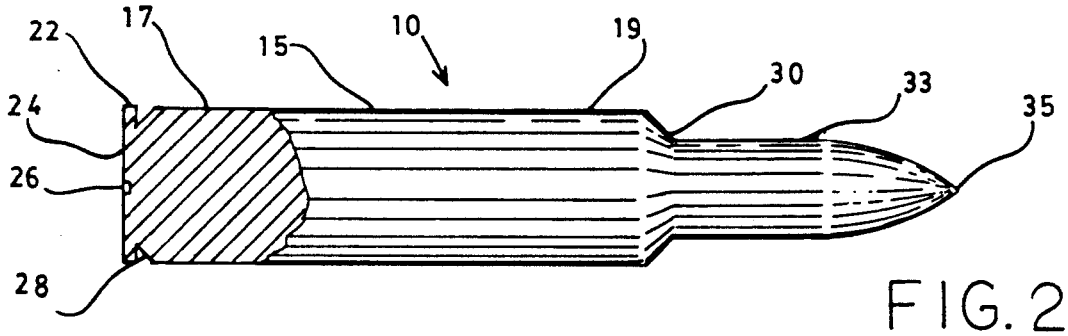
FIG. 2 illustrates a partial sectional view of the dummy round illustrated in FIG. 1.
Figure 3A:
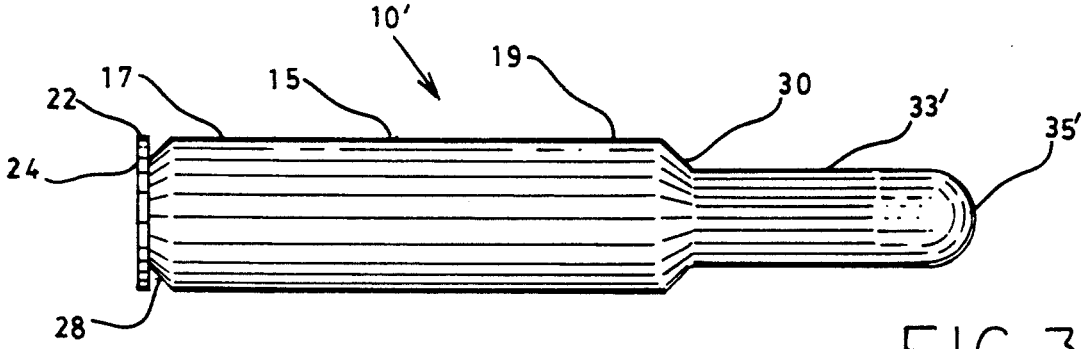
FIGS. 3A illustrates a side elevational view of an alternate configuration of the dummy round illustrated in FIG. 1.
Figure 3B:
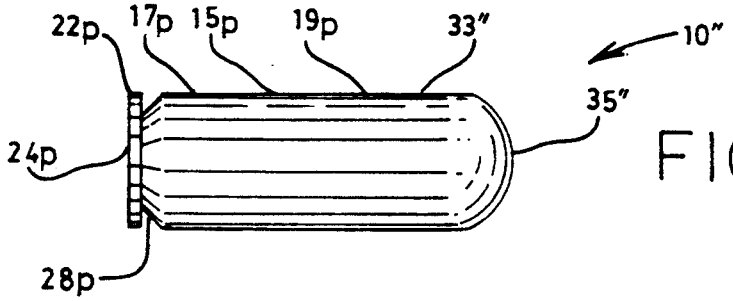
FIG. 3B illustrates a side elevational view of an alternate configuration of the dummy round illustrated in FIG. 1, which has been configured for use in a pistol.

Disposed at the forward portion 19 of the casing portion 15 is a tapered shoulder 30. Tapered shoulder 30 is disposed between casing portion 15 and bullet portion 33. Bullet portion 33 is dimensioned to have an external diameter that is slightly less than the internal diameter of the weapon's barrel 53, i.e. bullet 33 is dimensioned to be the same caliber as a standard round of live ammunition 54, having a separate bullet 58 and a separate casing 56, for the weapon 52 that is being used in conjunction with the dummy round. It will be understood by those skilled in the art that dummy round 10 can be configured for use as a training round in any conventional automatic or semi-automatic weapon and the configuration of the dummy round 10 shown in the figures is for illustrative purposes only and is not intended to limit the scope of the invention. For instance, while dummy round lo is shown in FIGS. 1 and 2 has having a bullet portion 33 with a pointed free end 35, FIG. 3A shows a dummy round 10' having bullet portion 33, with a rounded free end 35'. Likewise, while FIGS. 1, 2, 3A and 3B show dummy rounds which are configured for use in an automatic or semi-automatic rifle, FIG. 3B shows a dummy round 10'', constructed in accordance with the present invention that has been configured for use in an automatic or semi-automatic pistol. In FIG. 3B, the parts **15*p* ("p" to denote pistol), 17*p*, 19*p*, 22*p*, 24*p* and 28*p* correspond to and function the same as parts 15, 17, 19, 22, 24 and 28, respectively, in FIGS. 1 and 2. Further, bullet portion 33'' is dimensioned to match the caliber of the automatic or semi-automatic pistol in which the dummy round 10''** is to be used.

As mentioned above, dummy rounds 10, 10' and 10'' are fabricated preferably of a lightweight, substantially rigid material, more preferably of a lightweight metal that is selected so as to match the weight of a live round of standard ammunition. Most preferably, dummy rounds 10, 10' and 10'' are fabricated of brass. This allows the dummy round to be loaded into the chamber 60 of the weapon 52, via the loading mechanism 62 and ejected from the weapon 52, via the ejector mechanism 64, as shown in FIG. 4. It also prevents a trainee from noticing a perceptible weight difference in a clip loaded with all live rounds and one that has been loaded with a dummy round. This prevents the trainee from anticipating the dummy round during training and the trainee's reactions more closely resemble the reactions of a shooter that has had a misfire.

Dummy rounds 10, 10' and 10'' are also preferably one piece units. This eliminates the risk of having a bullet separate from the casing of a conventional dummy round and remain in the barrel. Those skilled in the art will readily recognize that attendant risk of damage to the weapon and personal injury that can result from firing a subsequently chambered round while a dummy round bullet remains lodged in the barrel of the weapon.

From the foregoing description, it will be recognized by those skilled in the art that a dummy round offering advantages over the prior art has been provided. Specifically, the dummy round provides a dummy round which can be used as a training round and which can be readily chambered in and ejected from a conventional semi-automatic or fully automatic weapon. Further, the dummy round provides a dummy round that has its bullet portion and casing portion as a single unit, thus eliminating the risk of separation of the bullet from the casing. Additionally the dummy round provides a dummy round that approximates the weight and feel of a conventional live round of ammunition.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A dummy round for use in a firearm during firearms training, the firearm firing a given caliber of live ammunition, a round of the live ammunition having a separate casing and bullet, the casing and bullet each having a particular weight, the firearm having a chamber, a loading mechanism, for loading the live ammunition in the chamber and an ejector mechanism, for ejecting the casing from the chamber when the live round of ammunition of the give caliber has been fired in the firearm, said dummy round comprising:

a casing portion being fabricated from a substantially rigid material of a weight such that said casing portion is comparable in weight to the casing of the live round of ammunition used in the firearm, said casing portion having a rearward portion and a forward portion, said casing portion having a configuration conforming to the casing of the live round of ammunition, said rearward portion having a rearward face, said rearward face defining a firing pin receiver centrally disposed in said rearward face of said rearward portion of said casing portion, said firing pin receiver defining an opening for receiving a firing pin of the firearm, said firing pin receiver receiving the firing pin of the firearm such that the firing pin does not contact said rearward portion of said casing portion;

a bullet portion being fabricated from a substantially rigid material of a weight such that said bullet portion is comparable in weight to the bullet of the live round of ammunition used in the firearm, said bullet portion carried by said forward portion of said casing portion, said bullet portion and said casing portion having a one-piece construction whereby said bullet portion and said casing portion are permanently affixed together, said bullet portion having a configuration conforming to the bullet of the live round of ammunition;

a button carried by said rearward portion of said casing portion, said button being engageable by the ejector mechanism for facilitating ejection of said dummy round from the chamber, whereby said dummy round can be quickly removed from the chamber and replaced with a live round ammunition; and an annular recess disposed between said button and said rearward portion of said casing portion, said annular recess further facilitating engagement of the ejector mechanism with said button.

2. The dummy round of claim 1 wherein said dummy round includes a tapered shoulder disposed between said bullet portion and said forward portion of said casing portion, said tapered shoulder conforming to the configuration of the live round of ammunition.

3. The dummy round of claim 1 wherein said dummy round is fabricated from brass.

4. A dummy round for use in a firearm during firearms training, the firearm firing a given caliber of live ammunition, a round of the live ammunition having a separate casing and bullet, the casing and bullet each having a particular weight, the firearm having a chamber, a loading mechanism, for loading the live ammunition in the chamber and an ejector mechanism, for ejecting the casing from the chamber when the live round of ammunition of the given caliber has been fired in the firearm, said dummy round comprising:

a casing portion being fabricated from a substantially rigid material of a weight such that said casing portion is comparable in weight to the casing of the live round of ammunition used in the firearm, said casing portion having a rearward portion and a forward portion, said casing portion having a configuration conforming to the casing of the live round of ammunition, said rearward portion having a rearward face, said rearward face defining a firing pin receiver centrally disposed in said rearward face, said firing pin receiver defining an opening for receiving a firing pin of the firearm, said firing pin receiver receiving the firing pin of the firearm such that the firing pin does not contact said rearward portion of said casing portion;

a bullet portion being fabricated from a substantially rigid material of a weight such that said bullet portion is comparable in weight to the bullet of the live round of ammunition used in the firearm, said bullet portion carried by said forward portion of said casing portion, said bullet portion and said casing portion having a one-piece construction whereby said bullet portion and said casing portion are permanently affixed together, said bullet portion having a configuration conforming to the bullet of the live round of ammunition;

a button carried by said rearward portion of said casing portion, said button being engageable by the ejector mechanism for facilitating ejection of said dummy round from the chamber, whereby said dummy round can be quickly removed from the chamber and replaced with a live round of ammunition;

an annular recess disposed between said button and said rearward portion of said casing portion, said annular recess further facilitating engagement of the ejector mechanism with said button; and a tapered shoulder disposed between said bullet portion and said forward portion of said casing portion, said tapered shoulder conforming to the configuration of the live round of ammunition.

5. The dummy round of claim 4 wherein said dummy round is fabricated from brass.

6. A dummy round of ammunition for use in a firearm, said dummy round comprising:

a casing portion being fabricated from a substantially rigid material defining a rearward portion and a forward portion, said rearward portion defining a rearward face, said rearward face defining a firing pin receiver centrally disposed in said rearward face, said firing pin receiver defining an opening for receiving a firing pin of the firearm, said firing pin receiver receiving the firing pin of the firearm such that the firing pin does not contact said rearward portion of said casing portion;

a bullet portion being carried by said forward portion of said casing portion, said bullet portion and said casing portion having a one-piece construction whereby said bullet portion and said casing portion are permanently affixed together, said one-piece construction of said bullet portion and said casing portion conforming to the configuration of a live round of ammunition;

a button portion being carried by said rearward portion of said casing portion, said button portion facilitating ejection of said dummy round from the firearm; and an annular recess being disposed between said button and said rearward portion of said casing portion, said annular recess facilitating ejection of said dummy round from the firearm.

7. The dummy round of claim 6 wherein said dummy round is fabricated from a substantially rigid material of a weight such that said dummy round is comparable in weight to a live round of ammunition used in the firearm.

8. The dummy round of claim 6 wherein said dummy round is fabricated from brass.

* * * * *